US006179239B1

(12) United States Patent
Linderoth

(10) Patent No.: US 6,179,239 B1
(45) Date of Patent: Jan. 30, 2001

(54) DRIVING DEVICE FOR A CABLE WINDING MACHINE

(75) Inventor: Gustaf Linderoth, Enköping (SE)

(73) Assignee: Nextrom Holding S.A. (CH)

( * ) Notice: Under 35 U.S.C. 154(b), the term of this patent shall be extended for 0 days.

(21) Appl. No.: 09/308,937

(22) PCT Filed: Nov. 28, 1997

(86) PCT No.: PCT/FI97/00737

§ 371 Date: Aug. 5, 1999

§ 102(e) Date: Aug. 5, 1999

(87) PCT Pub. No.: WO98/23521

PCT Pub. Date: Jun. 4, 1998

(30) Foreign Application Priority Data

Nov. 28, 1996 (SE) ..... 9604385

(51) Int. Cl.[7] ..... B65H 75/28; B65H 75/30

(52) U.S. Cl. ..... 242/393; 242/399.1; 242/582; 242/125.1

(58) Field of Search ..... 242/393, 390.8, 242/390.5, 390.6, 390.9, 399.1, 125.1, 582, 603, 470

(56) References Cited

U.S. PATENT DOCUMENTS

| | | | | |
|---|---|---|---|---|
| 2,225,180 | * | 12/1940 | Olesen | 242/125.1 |
| 2,904,273 | * | 9/1959 | Turner et al. | 242/470 |
| 4,609,160 | * | 9/1986 | Linderoth et al. | 242/125.1 |
| 4,781,335 | * | 11/1988 | Comopagnon | 242/470 |
| 5,123,602 | * | 6/1992 | Skalleberg et al. | 242/393 |
| 5,246,184 | * | 9/1993 | Trewhella | 242/125.1 |
| 5,288,031 | * | 2/1994 | Linderoth | 242/393 |
| 5,314,130 | * | 5/1994 | Wood et al. | 242/393 |

FOREIGN PATENT DOCUMENTS

| | | |
|---|---|---|
| 0094361 A3 | 11/1983 | (EP) . |
| 0430913 A1 | 6/1991 | (EP) . |
| 0449076A1 | 10/1991 | (EP) . |
| 2115652 A1 | 7/1972 | (FR) . |
| 427647 B | 4/1983 | (SE) . |
| 450184 B | 6/1987 | (SE) . |

* cited by examiner

*Primary Examiner*—John M. Jillions
(74) *Attorney, Agent, or Firm*—Nixon & Vanderhye P.C.

(57) ABSTRACT

Driving device for rotating a cable drum (3) in a cable winding machine comprising gripping pins (2) arranged in a support frame (1) for rotatably supporting the cable drum and a driving device (4) provided with a motor, and a driving wheel (6) coupled to the motor for engagement with one flange **(3*a*) of the drum. For drawing the end of the cable to a point (14) in the drum by means of a wire (13), a wire drum (8)** rotated by the motor of the driving wheel is fastened to the driving wheel.

7 Claims, 2 Drawing Sheets

DRIVING DEVICE FOR A CABLE WINDING MACHINE

The present invention relates to a driving device for rotating a cable drum in a cable winding machine comprising a support frame and gripping pins arranged in the support frame to co-axially grip the respective drum flanges and to rotatably support the drum, whereby the driving device comprises a motor supported by the support frame and a driving wheel coupled to the motor and engageable into driving contact with a drum flange.

Such a winding machine is used especially in the cable industry for winding a cable onto a drum or from a drum but the winding machine is equally applicable for winding other similar products, such as threads, cords etc. To simplify matters the word 'cable' will in this description be used to include all such products and areas of application.

The winding machine operates so that the drum is gripped by the gripping pins of the machine and lifted up from the floor level to a fixed winding position, after which the drum is rotated by means of a driving device, the driving wheel of which is pressed against one flange of the drum. A design of such a winding machine provided with a driving device is disclosed in the applicant's European Patent Application No 91104161.4 (publication No 0 449 076) of Mar. 18, 1991. The driving device of that design comprises a motor that is supported in the support frame of the winding machine and a driving wheel that is coupled to the motor through a gear. The rotation axis of the driving wheel is parallel to the gripping pin axle of the winding machine.

Before the actual winding of the cable on the drum can be started the leading end of the cable has to be fastened to the drum so that the end is easily accessible for testing when the drum has been full wound. This requires that the cable end is first drawn up to the drum and further to such a position in relation to one flange of the drum that the cable end can be fastened at a certain point of the flange of the drum. The point where the cable is to be fastened varies depending on the one hand on the cable type and on the other hand on the drum type in question. In delivery drums made of wood the drum flange is provided with an opening, through which the cable end is drawn and fastened to the outer side of the drum flange. In delivery drums made of metal or plastic one flange of the drum is usually provided with an inner helical element to guide the cable end up to the proximity of the outer edge of the flange of the drum. In steel drums intended for oil-filled cables the cable end is indended to be inserted into an opening in the cylindrical body of the drum and connected to an oil tank arranged in the centre of the drum.

For drawing the cable end, especially of heavy cables, up to the place where it is to be fastened to the drum a winch arrangement for cable winding machines has been developed as disclosed in European Patent Application No 094 361. The winch arrangement comprises a rope wheel that is mounted on one of the gripping pins of the winding machine and is brought by means of a driver in engagement with the gripping pin and the rotation machinery of the winding machine, and a traction rope that can be wound on the outer periphery of the rope wheel. The free end of the traction rope is provided with a quick-locking device for gripping the cable end.

When the winding of the cable is to be started the quick-locking device for the traction rope is fastened to the cable end, after which the winch arrangement is started by the driving machinery of the winding machine so that the cable is drawn towards the stationary cable drum, standing on the floor between the gripping pins of the winding machine, by means of the traction rope being wound onto the rotating rope wheel. The drawing of the cable continues until the cable end has passed through the opening in the drum flange and has reached the point whereto it is to be fastened. After that the cable drum is lifted up from the floor by means of the gripping pins and is caused to rotate by the driving machinery of the winding machine, which rotates the cable drum by means of one of the gripping pins. When the drum has been fully wound the driving machinery is stopped and the quick-locking device released.

However, such a winch arrangement requires rope wheels of various sizes for drums of various sizes in order to draw the cable length through the opening in the drum flange without difficulties. This means that with a winch arrangement of this kind all available drum sizes cannot be handled. Furthermore, such a winch arrangement cannot be used in other drum types provided with helical elements and with central fastening means, as has been described above.

The object of the present invention is to obtain a driving device for a cable winding machine, where the above mentioned drawbacks have been eliminated and that is suited for all the different drum types and sizes and also for all available types of cable fastening means. Thus the invention makes it possible to use only one driving device for a cable winding machine. This is achieved by a driving device according to the invention, characterized in that the driving device is a winch provided with a wire drum connected to the motor.

The invention is based on the idea that the driving device is used not only for its normal task i.e. for rotating the cable drum by a contact between the driving wheel of the driving device and the drum flange but also for an additional task i.e. to operate as a winch for drawing the cable. For this purpose the driving device only has to be provided with a wire drum, while the motor, driving axle and gear already are provided.

The invention will be described in more detail in the following with reference to the enclosed drawings in which:

FIGS. 1 and 2 are front and side views, respectively, of a cable winding machine provided with a driving device according to the invention, FIGS. 3–5 are side views on a larger scale of a first, second and third embodiment, respectively, of a driving device according to the invention, and FIGS. 6–10 show the principle of operation of a driving device according to the invention when it is used in connection with different kinds of cable fastening means.

As its main parts the cable winding machine illustrated in FIGS. 1 and 2 comprises a traverse-like support frame 1, two gripping pins 2 vertically displaceably mounted in the support frame for supporting a cable drum 3 and a driving arrangement for rotating the cable drum. The driving arrangement comprises in this embodiment a separate driving device 4 for a drum flange 3*a*. In other embodiments of the driving arrangement more than one driving device can be provided in contact with the drum flange.

Each driving device comprises a motor 5 and a driving wheel 6 mounted co-axially with it, which are connected to each other through a support bearing or some other kind of connecting means that is rigidly fastened to the support frame so that the driving wheel comes into contact with the peripheral edge of one drum flange when the drum is in an uplifted position, as has been shown in FIGS. 1 and 2. As regards this part of the machine the construction and operation of it substantially corresponds to what has been described and shown in said European Patent Application No 0 449 076.

The driving device of the invention is provided with a wire drum 8 fastened co-axially to the driving wheel on that side of the driving wheel that is facing the motor, see FIG. 3. The word 'wire' is in this connection used to comprise also a cord, a rope and similar drawing means. An embodiment such as this is best adapted for winding a cable onto a drum provided with an inserting opening for the cable end in one of the drum flanges, as will be described in more detail in connection with FIG. 6, or for winding a cable onto a drum provided with an inserting opening for the cable end in the cylindrical body of the drum, as will be described in more detail in connection with FIGS. 9 and 10.

Figure 1:
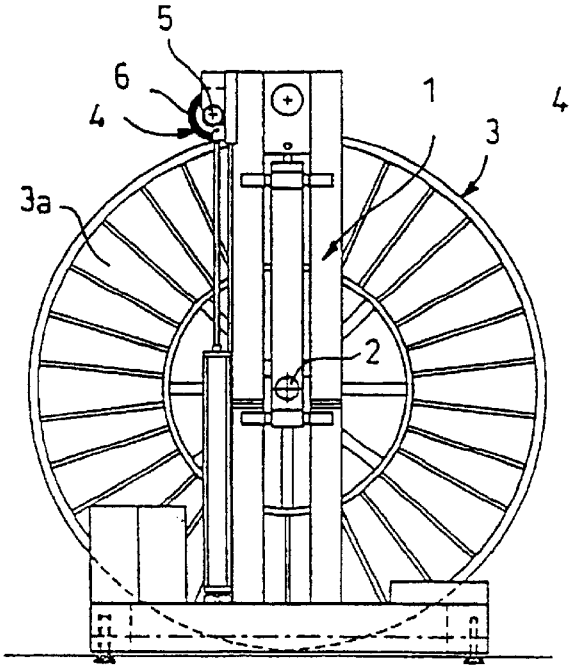
Figure 2:
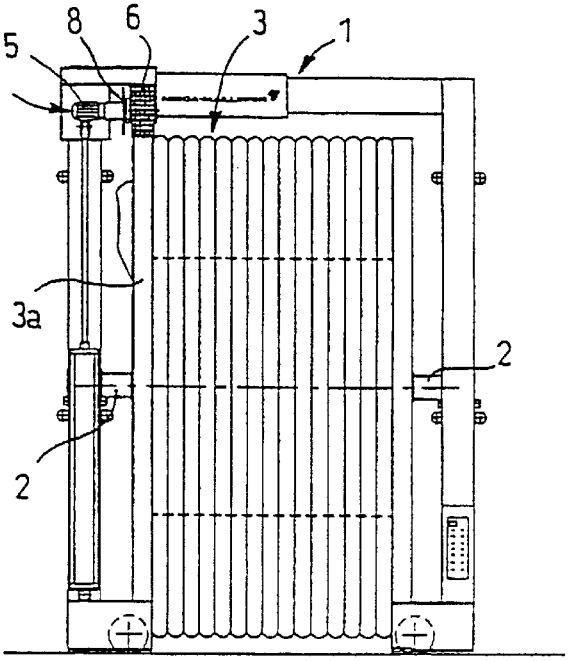
Figure 3:
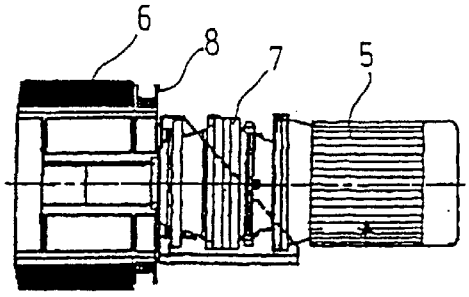
Figure 4:
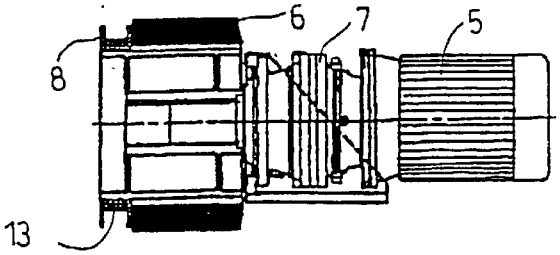
FIG. 4 shows an alternative embodiment of the driving device, where the wire drum 8 is mounted on that side of the driving wheel that is turned away from the motor. Such an embodiment is best adapted for winding a cable on a drum provided with an inner helical element for the cable end at one of the drum flanges, as will be described in more detail in connection with FIGS. 7 and 8.
Figure 5:
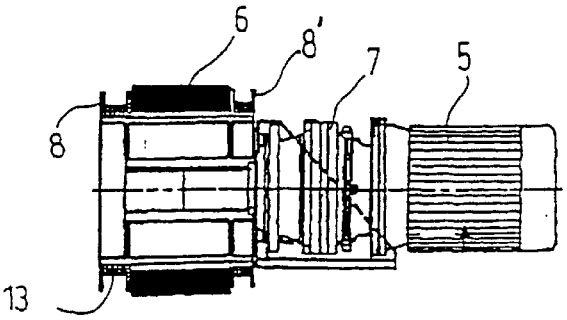
FIG. 5 shows a third embodiment of the driving device, where wire drums 8 and 8' are arranged on both sides of the driving wheel. Such an embodiment can be applied to all three types of fastening means for cable ends.
Figure 6:
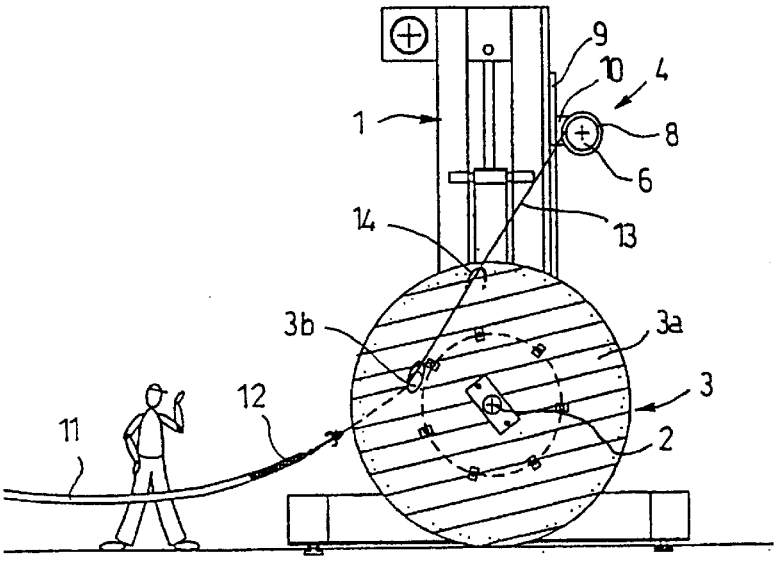

According to a preferred embodiment of the driving device of the invention shown in FIG. 6 the driving device 4 is vertically displaceable in relation to the support frame. Tracks 9 are fastened to the support frame, along which tracks a slide 10 is displaceable by means of a displacement appliance (not shown) arranged between the support frame and the slide.

When a cable 11 is to be wound onto a cable drum 3 provided with an opening 3b in the flange, according to FIG. 6, the drum resting on the floor is brought in engagement with the gripping pins of the winding machine and the driving device 4 is displaced to a suitable height so that the driving wheel 6 is free from contact with the flange 3*a* of the drum. The cable end is fastened by a quick-locking device 12 to the end of a wire 13 drawn from the wire drum 8 of the driving device, which wire runs through the opening in the drum flange. After that the driving device is started so that the wire is wound on the wire drum and the cable is drawn through the opening 3*b* in the cable drum flange from inside the drum to a fastening means 14 provided at the outer side of the flange. When the cable end has been fastened to the flange and the quick-locking device been released and wound on the wire drum, the cable drum is lifted up from the floor by the gripping pins to its rotating position and the driving device is displaced downwards so that the driving wheel comes into contact with the flange. Then the driving wheel is started to rotate the cable drum in the winding direction. When the drum has been fully wound the driving wheel is stopped and the cable drum lowered back to floor position and disengaged from the gripping pins.

Figure 7:
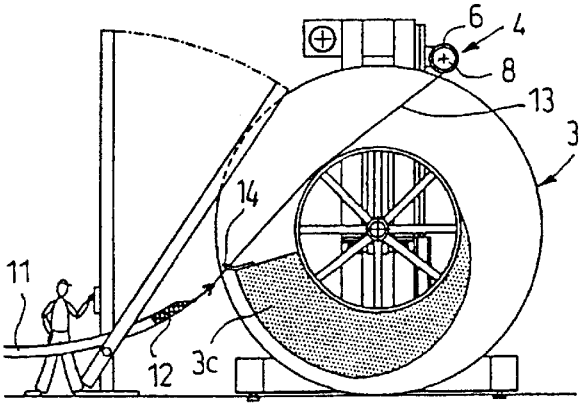
Figure 8:
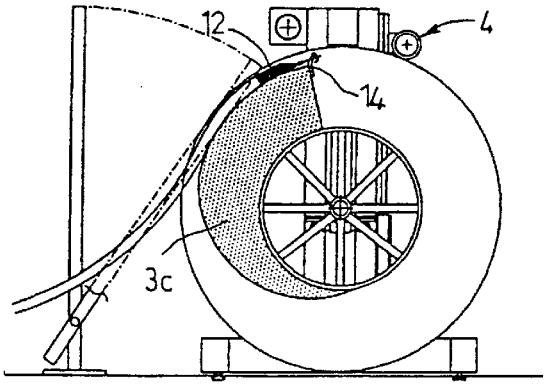

When a cable 11 is to be wound on a cable drum 3 provided with a helical element 3*c* on the inside of one of the drum flanges according to FIGS. 7 and 8, the drum is brought to rest on the floor in engagement with the gripping pins of the winding machine, whereby the driving wheel 6 of the driving device 4 is free from contact with the flange 3*a* of the drum. The cable end is fastened by a quick-locking device 12 to one end of a wire 13 extending from the wire drum 8 of the driving device. After that the driving device is started so that the wire is wound on the wire drum and the cable drawn to a fastening means 14 on the cable drum flange. When the cable end has been secured in the fastening means and the wire released and wound on the wire drum the cable drum is lifted up by the gripping pins from the floor so that the drum flange comes into contact with the driving wheel of the driving device. After that the driving wheel is started to rotate the cable drum in the winding direction. As the drum is fully wound the driving wheel is stopped and the cable drum lowered back to floor position and released from the gripping pins.

Figure 9:
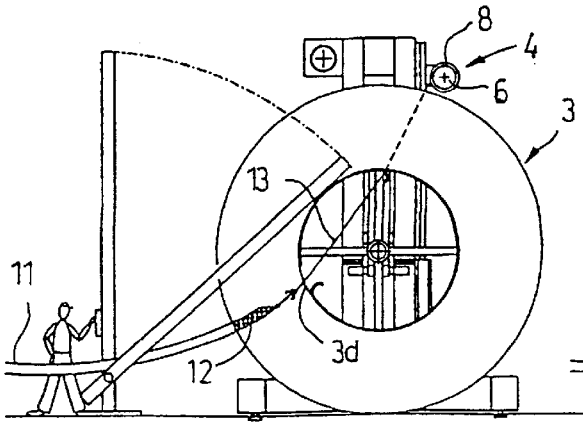
Figure 10:
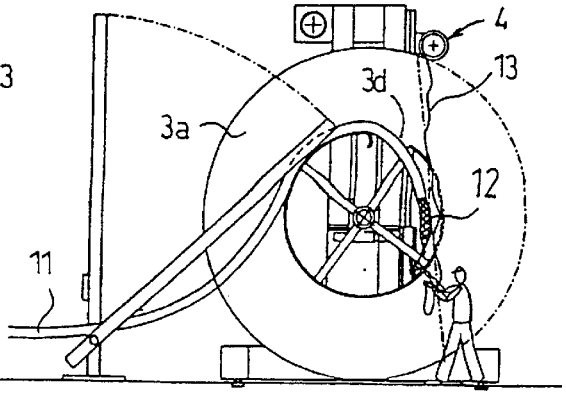

When a cable 11 is wound that must be fastened to the cylindrical body of the cable drum and be drawn through an opening 3d in the body according to FIGS. 9 and 10, the procedure is substantially the same as has been described in connection with FIGS. 7 and 8.

The driving device of the invention can in its details vary within the scope of the claims. By the word 'wire drum' is in this connection generally meant different kinds of drums, wheels and such. Instead of the wire drum being fastened to the driving wheel the wire drum can be fastened to the same shaft that supports the driving wheel.

What is claimed is:

1. Driving device for rotating a cable drum (3) in a cable winding machine, which winding machine comprises a support frame (1) and gripping pins (2) arranged in the support frame to co-axially grip the respective drum flanges (3*a*) and to rotatably support the drum, whereby the driving device (4) comprises a motor (5) supported by the support frame and a driving wheel (6) coupled to the motor and engageable into driving contact with a drum flange, characterized in that the driving device (4) is a winch provided with a wire drum (8) connected to the motor (5).

2. Driving device according to claim 1, characterized in that the wire drum (8) is rigidly fastened co-axially to the driving wheel (6).

3. Driving device according to claim 1, characterized in that the wire drum (8) is non-rotatingly fastened co-axially to the driving shaft of the driving wheel (6).

4. Driving device according to claim 2, characterized in that the wire drum (8) is positioned on that side of the driving wheel (6) that is turned away from the motor (5).

5. Driving device according to claim 2, characterized in that the wire drum (8) is positioned on that side of the driving wheel (6) that is facing the motor (5).

6. Driving device according to claim 2, characterized in that a wire drum (8) is provided on that side of the driving wheel (6) that is turned away from the motor (5) as well as on that side that is facing the motor.

7. Driving device according to claim 1, characterized in that the wire drum (8) and the driving wheel (6) are mounted on a slide (10), which is vertically displaceably supported by tracks (9) provided in the support frame (1).

* * * * *